US005104465A

United States Patent [19]

McAuliffe et al.

[11] Patent Number: 5,104,465

[45] Date of Patent: Apr. 14, 1992

[54] ALUMINUM ALLOY SHEET STOCK

[75] Inventors: Doanld C. McAuliffe, Golden; Ivan M. Marsh, Denver, both of Colo.

[73] Assignee: Golden Aluminum Company, Lakewood, Colo.

[21] Appl. No.: 577,880

[22] Filed: Sep. 5, 1990

Related U.S. Application Data

[63] Continuation-in-part of Ser. No. 315,408, Feb. 24, 1989, Pat. No. 4,976,790.

[51] Int. Cl.[5] ..... C22C 21/06; C21D 8/00

[52] U.S. Cl. ..... 148/439; 148/2; 148/11.5 A; 148/437; 148/440; 206/139; 420/533

[58] Field of Search ..... 148/2, 11.5 A, 437, 148/439, 440; 206/139; 420/533

[56] References Cited

U.S. PATENT DOCUMENTS

| | | | |
|---|---|---|---|
| 3,219,492 | 11/1965 | Anderson et al. | 148/11.5 |
| 3,379,583 | 4/1968 | Gruhl et al. | 148/11.5 |
| 3,397,044 | 8/1968 | Bylund | 29/183 |
| 3,560,269 | 2/1971 | Anderson et al. | 148/11.5 |
| 3,563,815 | 2/1971 | Meier et al. | 148/12.7 |
| 3,571,910 | 3/1971 | Bylund | 29/527.7 |
| 3,709,281 | 1/1973 | Bolliger | 164/153 |
| 3,744,545 | 7/1973 | Gyongyos | 164/4 |
| 3,747,666 | 7/1973 | Gyongyos | 164/279 |
| 3,759,313 | 9/1973 | Gyongyos | 164/87 |
| 3,774,670 | 11/1973 | Gyongyos | 164/279 |
| 3,787,248 | 1/1974 | Setzer et al. | 148/11.5 |
| 3,909,316 | 9/1975 | Hirata | 148/156 |
| 3,930,895 | 1/1976 | Moser et al. | 148/2 |
| 4,235,646 | 11/1980 | Neufeld et al. | 148/2 |
| 4,238,248 | 12/1980 | Gyongyos et al. | 148/2 |
| 4,269,632 | 5/1981 | Robertson et al. | 148/2 |
| 4,282,044 | 8/1981 | Robertson et al. | 148/2 |
| 4,318,755 | 3/1982 | Jeffrey et al. | 148/11.5 |
| 4,411,707 | 10/1983 | Brennecke et al. | 148/2 |
| 4,582,541 | 4/1986 | Dean et al. | 148/2 |
| 4,929,285 | 5/1990 | Zaidi | 148/440 |

*Primary Examiner*—R. Dean
*Assistant Examiner*—Robert R. Koehler
*Attorney, Agent, or Firm*—Sheridan, Ross & McIntosh

[57] ABSTRACT

An aluminum sheet having novel properties is provided. The strip stock is suitable for the fabrication of both container ends and container bodies in thinner gauges than are typically employed, has low earing characteristics and may be derived from recycled aluminum scrap. An alloy particularly suited to the fabrication of the aluminum sheet preferably has a magnesium concentration of from about 2 to about 2.8 weight percent and a manganese concentration of from about 0.9 to about 1.6 weight percent. A process particularly suited to the fabrication of the aluminum sheet preferably includes continuous chill block casting the alloy melt into a strip, hot rolling the strip to a first thickness, annealing the hot rolled strip and then cold rolling the annealed strip to a final thickness. Cold rolling preferably includes two stages with an intermediate anneal step between the two stages. The process increases tensile and yield strength while decreasing earing percentage, even in very thin gauges, such as 0.010 inches.

18 Claims, 4 Drawing Sheets

EARING (REDRAW) AND YIELD STRENGTH
VS. COLD WORK

ALUMINUM ALLOY SHEET STOCK

RELATED APPLICATION

This application is a continuation-in-part of co-pending and commonly assigned U.S. patent application Ser. No. 07/315,408 filed Feb. 24, 1989, now U.S. Pat. No. 4,976,790, incorporated herein by reference in its entirety.

TECHNICAL FIELD OF THE INVENTION

This invention relates to production of aluminum sheet stock having reduced earing and improved strength which is suitable for conversion into useful products, such as container ends and container bodies.

BACKGROUND OF THE INVENTION

In recent years, substantial effort has been made to produce an aluminum alloy which is suitable without modification for the manufacture of both container bodies and container ends. Aluminum beverage containers are generally made in two pieces, one piece forming the container sidewalls and bottom (collectively referred to herein as "container body") and a second piece forming the container top. Using methods well known in the art, a container body is formed by cupping a circular blank of aluminum sheet and then drawing and ironing the cupped sheet by subsequently extending and thinning the sidewalls by passing the cup through a series of dies with diminishing bores. The result is an integral body with sidewalls thinner than the bottom. A common alloy used to produce container bodies is AA 3004 (an alloy registered with the Aluminum Association) whose characteristics are appropriate for the drawing and ironing process due primarily to low magnesium (Mg) and manganese (Mn) concentrations.

However, alloys such as AA 3004 having low magnesium content usually possess insufficient strength to be used for the fabrication of container ends with easy open "ring pulls" or the like. Therefore, alloys with a higher magnesium concentration, such as AA 5082 or AA 5182 alloys, are used for container ends. Table 1 provides a comparison of the major components of alloys AA 3004, 5082 and 5182, as well as other alloys discussed herein.

TABLE 1

| | Alloy | Mn | Mg | Si | Cu | Fe | Ti | Cr | Zn |
|---|---|---|---|---|---|---|---|---|---|
| | | | | (weight %)* | | | | | |
| 1. | AA 3004 | 1.0–1.5 | 0.8–1.3 | 0.30 | 0.25 | 0.70 | — | — | 0.25 |
| 2. | AA 5082 | 0.15 | 4.0–5.0 | 0.20 | 0.15 | 0.35 | 0.10 | 0.15 | 0.25 |
| 3. | AA 5182 | 0.20–0.50 | 4.0–5.0 | 0.20 | 0.15 | 0.35 | 0.10 | 0.10 | 0.25 |
| 4. | U.S. Pat. No. 3,560,269 | 0.2–0.7 | 4–5.5 | 0.3 | 0.2 | 0.3 | 0.1 | 0.2 | — |
| 5. | AA 5017 | 0.6–0.8 | 1.3–2.2 | 0.15–0.4 | 0.18–0.28 | 0.3–0.7 | — | — | — |
| 6. | Melt: 75% 3004 25% 5182 | 0.8 | 1.5 | 0.2 | 0.1 | 0.4 | 0.04 | — | — |
| 7. | Adjusted Melt | 0.4–1.0 | 1.3–2.5 | 0.1–1.0 | 0.05–0.4 | 0.1–0.9 | 0–0.2 | — | — |
| 8. | U.S. Pat. No. 3,787,248 | 0.5–2.0 | 0.4–2.0 | ≦0.5 | ≦0.5 | ≦1.0 | ≦0.1 | ≦0.2 | ≦0.5 |

*The remainder being aluminum.

A completed container (a body together with an end) must be able to withstand an internal pressure of at least about 60 psi if it is to contain unpasteurized beer and at least about 90 psi if it is to contain pasteurized beer, soda pop, or any beverage having similarly high carbonation levels. Currently, containers fabricated from AA 3004 body alloy and AA 5082 end stock are able to withstand 90 psi of internal pressure if fabricated from aluminum sheet having a gauge of about 0.0116 inches. Containers made from thinner gauges employ less sheet material than those made from thicker gauges and are therefore less expensive to produce. However, containers made from thinner gauge stock, such as 0.0110 inches, have not been sufficiently strong to withstand 90 psi of internal pressure or have not been sufficiently strong to survive the rigors encountered during long distance transportation.

Another desirable characteristic of an aluminum alloy sheet which is to be drawn and ironed is that the sheet have a low earing percentage. As used herein, the term "earing percentage" (also referred to herein as "earing") refers to the 45° earing or 45° rolling texture. This value is determined by measuring the height of ears which stick up in a drawn cup minus the height of valleys between the ears. This difference is divided by the height of the valleys times 100 to convert to a percentage. The 45° earing is measured at 45° to the longitudinal axis of the strip. Due to this earing, the rim of the shell often becomes deformed and takes on a scalloped appearance.

Because this earing must be removed before the container body is completed, waste occurs. Furthermore, excessive earing, greater than about 2 percent as measured by the Olsen cup test, may also interfere with the drawing apparatus. Minimizing earing helps to minimize waste and simplifies the production process.

One step that has been used to reduce earing is to reduce the cold work percentage (or the percent thickness reduction during the step of cold rolling an alloy sheet). As illustrated in FIG. 1, when AA 5017 alloy is employed, earing decreases as the cold work percentage decreases. However, as further illustrated in FIG. 1, the yield strength also decreases as the cold work percentage decreases. Therefore, increasing the cold work to form stock with thinner gauges or greater strength produces unacceptably high earing. Conversely, reducing the earing by reducing the cold work results in thicker stock with relatively low strength.

Aluminum alloys may be produced by direct chill casting of molten alloy into ingots which are then rolled into strips or may be produced by a continuous strip casting process. Apparatus for continuous strip block casting is described in U.S. Pat. Nos. 3,709,281, 3,744,545, 3,747,666, 3,759,313 and 3,774,670. Although there exist numerous variations of the continuous block casting process, all of the processes generally include the steps described hereinbelow.

Molten aluminum alloy is injected through a nozzle or distributor tip into a cavity formed between two sets of oppositely rotating chilled blocks. While in the cavity, the alloy cools and solidifies to form an aluminum sheet. The aluminum sheet then passes between rollers to further reduce the thickness of the strip. This is typically referred to as hot rolling.

As the continuous strip comes out of the hot rolling step, it is coiled and allowed to cool. The cooled coil is then cold rolled to reduce its thickness still further. Often, the strip will be cold rolled in several passes with an intermediate annealing step between each cold rolling pass.

When the alloy strip has been reduced to its final thickness, it can be cut into appropriate shapes for the production of useful products, such as container bodies or container ends. Typically, at various stages of the process, scrap is produced (plant scrap).

Several patents pertain to low earing aluminum alloys or processes for their production. For example, U.S. Pat. No. 4,238,248 by Gyongyos et al., issued on Dec. 9, 1980, discloses a process for producing a low earing aluminum alloy. A melt of 3004 alloy, or an alloy in which the combined concentration of manganese and magnesium is between 2 percent and 3.3 (unless otherwise indicated, all percentages will be weight percent) percent and in which the ratio of magnesium:manganese is between 1.4:1 and 4.4:1, is cast and then held for 2 to 15 minutes between 400° C. and the alloy's liquidus temperature (the temperature at which the alloy's phase changes between a liquid state and a solid/liquid state, in this case, approximately 600° C.). It is then hot rolled at a temperature between 300° C. and the non-equilibrium solidus temperature (the temperature at which the alloy's phase changes between the solid/liquid state and a completely solid state), coiled and cooled to room temperature. A first cold rolling stage reduces the thickness by at least 50 percent and is followed by a flash annealing stage at 350° C. to 500° C. for less than 90 seconds. A second cold rolling stage results in further reduction of up to 75 percent.

U.S. Pat. No. 3,560,269 by Anderson et al., issued on Feb. 2, 1971, discloses an aluminum alloy, the composition of which is set forth in Table 1. An ingot is cast by direct chill casting, heated to 800° F., and held at that temperature for 24 hours. The ingot is hot rolled and the resulting strip is annealed at 700° F. A first cold rolling stage reduces the thickness by at least 85 percent and is followed by annealing at 600° F. An optional second cold rolling stage provides further reduction of at least 30 percent to a final thickness. The resulting sheet is described as having earing of not more than 3 percent, an amount which, according to the inventors, is acceptable.

As noted above, the required characteristics of alloy for container ends differ from those of container bodies; melting recycled aluminum containers (a combination of ends and bodies) produces a melt which may be unsatisfactory for the production of either container bodies or container ends. The weight percents of the components of a typical melt of recycled aluminum comprising approximately 25 percent container ends and 75 percent container bodies are shown in Table 1. Efforts have been made to produce an alloy from recycled aluminum containers which is suitable for both container bodies and container ends.

U.S. Pat. Nos. 4,411,707 by Brennecke et al., issued on Oct. 25, 1983; 4,282,044 by Robertson et al., issued on Aug. 4, 1981; 4,269,632 by Robertson et al. issued on May 26, 1981; 4,260,419 by Robertson et al. issued on Apr. 7, 1981; and 4,235,646 by Neufeld et al. issued on Nov. 25, 1980 disclose related methods for processing recycled aluminum containers. All begin with an initial melt of approximately 25 weight percent container ends and approximately 75 weight percent container bodies, as shown in Table 1. The initial melt is then adjusted, generally by the addition of pure aluminum, to form an alloy whose composition is also shown in Table 1. The combined concentration of manganese and magnesium is within the range of 2.0 to 3.3 percent and the ratio magnesium:manganese is within the range of 1.4:1 to 4.4:1.

The differences among the foregoing patents occur in the way the alloy is cast and processed after being adjusted to the desired composition.

U.S. Pat. Nos. 4,235,646, 4,260,419 and 4,282,044 each disclose a continuous strip casting process in which the alloy strip (having the composition previously described) is held at a temperature between 400° C. and 600° C. for 2 to 15 minutes after it has been cast. It is then hot rolled for a thickness reduction of at least 70 percent, coiled and allowed to cool to room temperature. The strip is then uncoiled and cold rolled to a final thickness in either one or two steps. If cold rolling occurs in two steps, the first results in a reduction of at least 50 percent and is followed by a flash anneal in which the alloy is heated to between 350° C. and 500° C. and then cooled down to room temperature, all within a period not exceeding 90 seconds. The alloy is cold rolled a second time producing additional reduction of 75 percent or less.

U.S. Pat. No. 4,269,632 and 4,260,419 disclose direct chill casting methods of the melt described above in which the resulting cast ingot is held at a temperature between 550° C. and 600° C. for 4 to 6 hours and then allowed to cool. It is hot rolled when its temperature is between 450° C. and 510° C. producing a thickness reduction of between 40 percent and 96 percent. The resulting strip is hot rolled a second time for an additional reduction of between 70 percent and 96 percent. The strip is coiled and then annealed in one of two ways. It may be flash annealed for 30 to 90 seconds between 350° C. and 500° C. or, it may be annealed for 2 to 4 hours between 315° C. and 400° C. After annealing, the strip is allowed to cool and is then cold rolled in one or more stages to produce a total reduction of approximately 89 percent in thickness. After each cold rolling stage, the alloy is annealed using either a flash or conventional method.

U.S. Pat. No. 4,411,707 discloses a process for producing container ends from the previously described scrap melt using a variation of the continuous chill roll casting method. The molten alloy, between 682° C. and 710° C., is cast to a thickness between 0.23 and 0.28 inches and then rolled to reduce the thickness to approximately 25 percent. The strip is coiled and allowed to cool to room temperature after which it is cold rolled in at least two stages. In the first, a reduction of at least 60 percent in thickness occurs and in the second, a reduction of at least 85 percent occurs. The alloy is annealed for approximately 2 hours at 440° C. to 483° C. between the two cold rolling stages. Additional cold rolling/annealing stages can be used if desired.

U.S. Pat. No. 3,787,248 by Setzer et al., issued on Jan. 22, 1974, also discloses a process for producing an alloy from a melt of recycled aluminum containers which is suitable for both container ends and container bodies. The composition of the alloy is set forth in Table 1. Any conventional casting method may be used (although a preference is stated for direct chill casting) after which the alloy is homogenized for 2 to 24 hours between 850° F. and 1150° F. The metal is then hot rolled at least twice, the first time achieving at least a 20 percent reduction in thickness at a temperature between 650° F. and 950° F. and the second, also achieving at least a 20 percent reduction, between 400° F. and 800° F. A third rolling operation (comparable to cold rolling), at a temperature less than 400° F., achieves at least a 20% reduction to the final thickness. The alloy is then annealed between 200° F. and 450° F. for a period greater than 5 seconds (preferably between 30 minutes and 8 hours). Instead of a single cold rolling step, the aluminum strip may be cold rolled and annealed two or three times to obtain the final thickness.

U.S. Pat. No. 4,318,755 by Jeffrey et al., issued on Mar. 9, 1982 discloses an aluminum alloy, the composition of which is set forth in Table 1, suitable for container bodies made from recycled containers using continuous strip casting methods. The strip exits the caster at 380° C. to 450° C. and is hot rolled to reduce the thickness between 72 percent and 82 percent; the strip exits the hot roller between 150° C. and 200° C. and is coiled. The strip is then cold rolled to its final thickness and is either annealed for 2 hours between 400° C. and 420° C. or flash annealed.

It would be useful to provide an aluminum alloy sheet which has a low earing percentage, which possesses good strength characteristics in thinner gauges than are presently employed and which is suitable for use in the production of both container bodies and container ends. It would also be useful to provide such a sheet from an alloy which can be produced substantially from recycled aluminum containers.

SUMMARY OF THE INVENTION

In accordance with the present invention, aluminum sheet having novel properties is provided. The aluminum sheet (also known as strip stock) is suitable for the fabrication of both container ends and container bodies in gauges thinner than typically currently employed, has low earing properties and can be formed at least in part from recycled aluminum scrap.

An initial alloy melt may be formed from aluminum scrap, including plant, container and consumer scrap, which is then adjusted to form the alloy composition of the present invention. This composition preferably comprises: about 2.0 percent to about 2.8 percent magnesium; about 0.9 percent to about 1.6 percent manganese and preferably from about 1.1 percent to about 1.6 percent manganese; about 0.13 percent to about 0.20 percent silicon; about 0.20 percent to about 0.25 percent copper and about 0.30 percent to about 0.35 percent iron, the balance being essentially aluminum. The adjusted melt is preferably cast into strips and is hot rolled to a first thickness. The hot rolled strip is annealed and then cold rolled in at least one pass to a final gauge.

The aluminum sheet of the present invention provides the technical advantage of having low earing and being suitable for fabrication of both container ends and container bodies in thinner gauges than are possible using prior known sheets. The present invention has the further technical advantage of permitting the aluminum alloy stock to be derived from aluminum scrap.

DETAILED DESCRIPTION OF THE INVENTION

Figure 1:
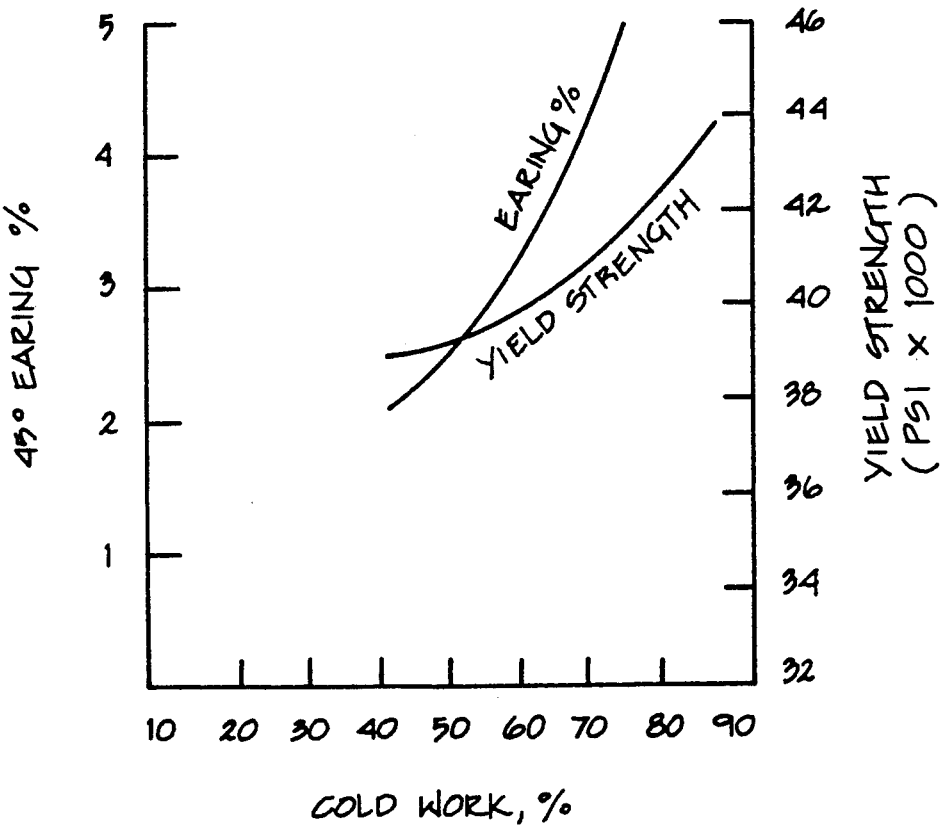
FIG. 1 is a graph illustrating relationships between yield strength and cold work, and earing and cold work.

In accordance with the present invention, an aluminum strip or sheet stock is provided. The sheet stock has a reduced earing percentage and improved strength in thinner gauges than aluminum sheet that is presently fabricated. The sheet stock can be fabricated from an alloy having a composition which can be derived, at least in part, from recycled aluminum scrap. The sheet stock can be fabricated using a process which includes the steps of casting, hot rolling, annealing and cold rolling. The aluminum sheet of the present invention is especially suitable for use in the fabrication of deep drawn and ironed articles, such as beverage container bodies, as well as beverage container ends.

A preferred alloy for use in the sheet of the present invention is disclosed in U.S. patent application Ser. No. 907/578,019, entitled "Aluminum Alloy Composition," and filed on even date herewith. A preferred process for the manufacture of aluminum sheet of the present invention is disclosed in U.S. patent application Ser. No. 07/579,352, entitled "Process of Fabrication of Aluminum Sheet," and filed on even date herewith. Both of these applications are incorporated herein by reference in their entirety.

According to the present invention, an aluminum alloy composition especially suitable for the manufacture of aluminum sheet of the present invention preferably includes at least about 0.9 weight percent manganese, and more preferably from about 1.1 weight percent to about 1.6 weight percent manganese. The alloy composition further includes from about 2.0 weight percent to 2.8 weight percent magnesium. In addition to the manganese and magnesium, the aluminum alloy preferably has from about 0.13 weight percent and about 0.20 weight percent silicon, from about 0.20 weight percent to about 0.25 weight percent copper, and from about 0.30 weight percent to about 0.35 weight percent iron, the balance being essentially aluminum. The foregoing constitutes the primary alloying elements of the aluminum alloy. In addition to these primary aluminum alloying agents, traces of other elements, such as titanium, chromium and zinc, may be present in the composition. It is preferable that such impurities do not exceed a total of about 0.2 weight percent, and that none of the impurity elements comprise more than about 0.05 weight percent individually.

According to the present invention, the amounts of magnesium and manganese can vary within the above-described ranges, and an alloy suitable for the manufacture of drawn and iron container bodies will still result. According to one composition of the alloy, the magnesium is present in an amount from about 2.6 weight percent to about 2.8 weight percent while the manganese is present in an amount from about 1.1 weight percent to about 1.5 weight percent. In another composition, the magnesium is present in an amount from about 2.0 weight percent to about 2.1 weight percent while the manganese is present in an amount from about 1.4 weight percent to about 1.6 weight percent In yet another composition, the magnesium is present in an amount from about 2.6 weight percent to about 2.8 weight percent, while the manganese is present in an amount from about 0.9 weight percent to about 1.0 weight percent.

It has been found particularly advantageous to minimize the ratio of magnesium to manganese within these ranges. Accordingly the ratio of magnesium to manganese is preferably less than about 3.2:1, more preferably less than about 2.2:1, and most preferably less than about 1.5:1. It has been found that decreasing the ratio of magnesium to manganese (that is, increasing the amount of manganese relative to the magnesium, or decreasing the amount of magnesium relative to the manganese) permits a hot rolled strip of the present alloy to tolerate greater cold work, thus increasing the strength and reducing the thickness, without increasing the earing.

Table 2 provides the preferred broad ranges for manganese and magnesium concentrations in the alloy which is particularly suited to fabrication of aluminum sheet of the present invention as well as the ranges of manganese and magnesium concentrations in three more preferred compositions (Alloys A, B, and C) and their Mg:Mn ratios:

TABLE 2

| | Broad Range | (weight percent) Alloy A | Alloy B | Alloy C |
|---|---|---|---|---|
| Mn | 0.9-1.6 | 0.9-1.0 | 1.3-1.5 | 1.5-1.6 |
| Mg | 2.0-2.8 | 2.6-2.8 | 2.6-2.8 | 2.0-2.1 |
| Mg:Mn | 1.25:1-3.11:1 | 2.6:1-3.11:1 | 1.73:1-2.15:1 | 1.25:1-1.4:1 |

While not wishing to be bound by theory, it is believed that each 0.1 weight percent increase in the concentration of manganese increases the yield strength of an aluminum sheet formed from the alloy by approximately 660 psi (4.5 MPa). Increasing the cold work percentage during processing may also increase the yield strength; however, cold working also tends to increase the earing percentage when an alloy blank is drawn and ironed into a beverage container. FIG. 1 graphically illustrates these relationships for an AA 5017 alloy. The strip stock produced from the alloy and process of the present invention advantageously provides increased yield strength by increasing the amount of manganese in the alloy, but maintains a low earing percentage.

The alloy used to fabricate aluminum sheet of the present invention may be obtained by melting the primary constituents together or may be obtained by adjusting the composition of a melt of scrap aluminum. As used herein, the term scrap aluminum refers to aluminum that may comprise plant, container and consumer scrap in which container body alloy, eg. AA 3004, and container end alloy, eg. AA 5082 and AA 5182, are present in a weight ratio of approximately 3:1. As previously noted, such a scrap melt will typically have a manganese content of approximately 0.8 weight percent and a magnesium content of approximately 1.5 weight percent. Adjustment to provide the composition of the present invention can involve the addition of unalloyed aluminum, manganese, magnesium or combinations of the three.

Figure 2:
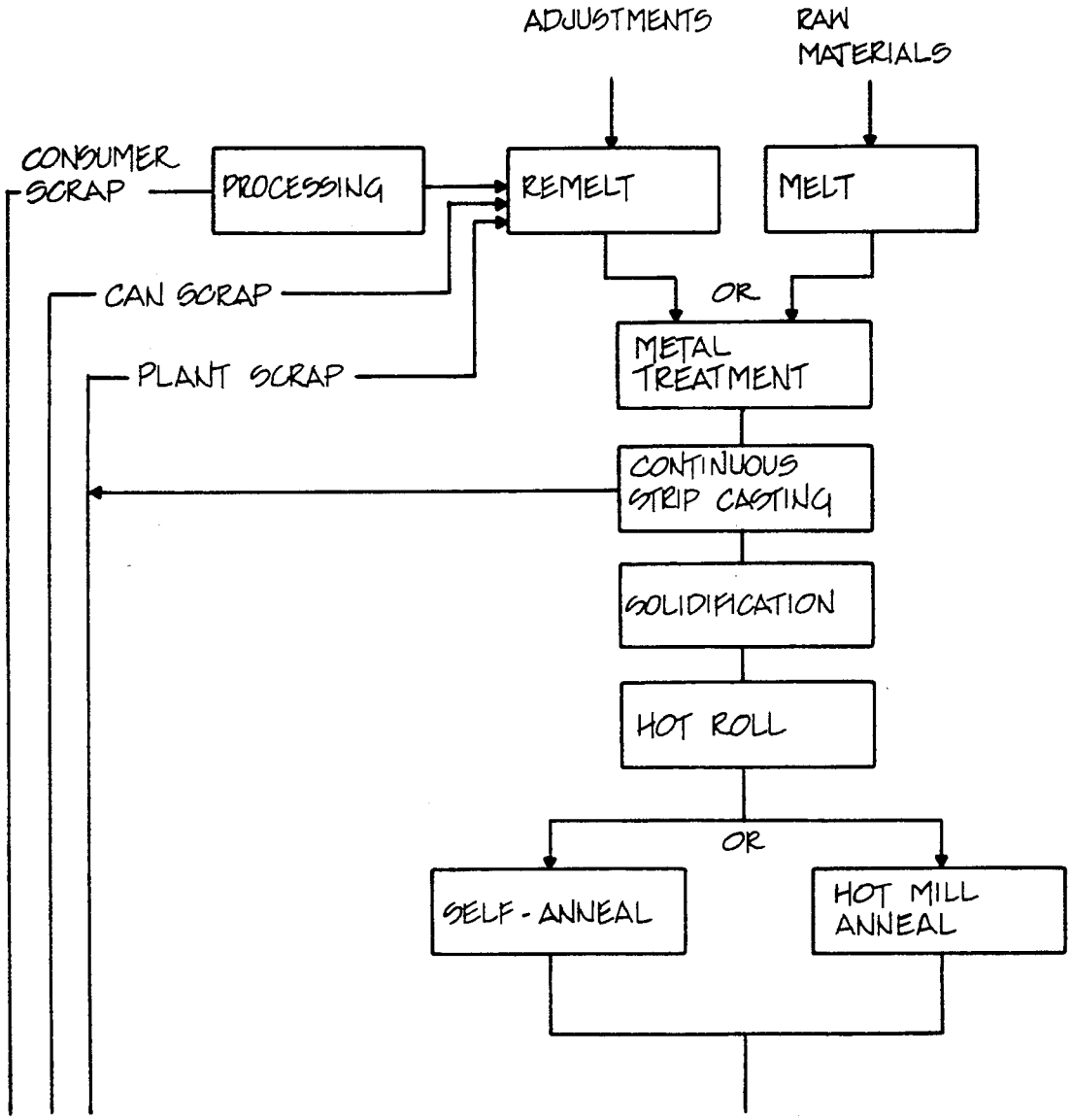
FIGS. 2 and 2*a* are a flowchart of embodiments of a process useful for the fabrication of aluminum sheet of the present invention.
Figure 2A:
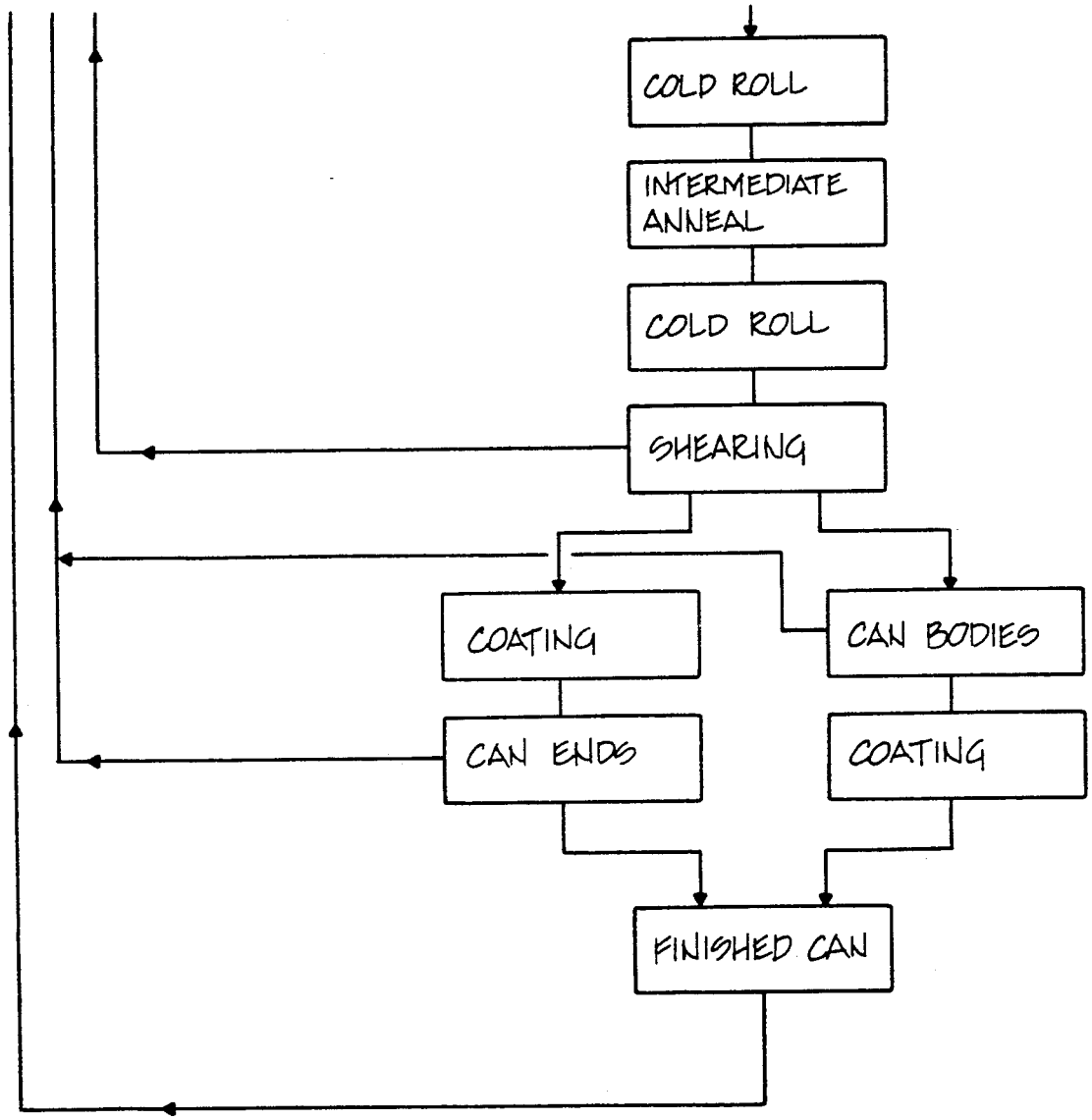

The aluminum sheet of the present invention can be fabricated from aluminum alloy compositions utilizing any means known in the art, eg. direct chill casting, ingot casting, or block casting. According to the present invention, it is preferable to utilize a block casting technique. A block casting technique is shown graphically in the flowchart of FIG. 2 and 2*a*. The block caster is preferably cast of the type disclosed in U.S. Pat. Nos. 3,709,281, 3,744,545, 3,747,666, 3,759,313 and 3,774,670, which are incorporated herein by reference in their entirety.

Once the proper alloy composition is formed, the melt is preferably cast through a nozzle with a 16 millimeter tip. The melt is cast in a casting cavity formed by opposite pairs of rotating blocks, preferably to a thickness of less than about 0.8 inches (20 mm), and more preferably from about 0.6 to 0.8 inches (15.2 mm to 20 mm).

The strip of metal travels as it cools and solidifies along with the chilling blocks until the strip exits the casting cavity where the chilling blocks separate from the cast strip and travel to a cooler where the chilling blocks are cooled. The rate of cooling as the cast strip passes through the casting cavity of the chill block casting machine is controlled by various process and product parameters. These parameters include the composition of the material being cast, the strip gauge, the chill block material, the length of the casting cavity, the casting speed and the efficiency of the chill block cooling system.

It is preferred that the cast strip be as thin as possible. This minimizes subsequent working of the strip. Normally, a limiting factor in obtaining minimum strip thickness is the size of the distributor tip of the caster. In the preferred embodiment of the present invention, the strip is cast at a thickness from about 0.6 to about 0.8 inches (15.2 mm to 20 mm). However, thinner strip can be cast.

The cast strip normally exits the block caster in the temperature range from about 850° F. to about 1100° F. (450° C. to 595° C.). Upon exiting the caster, the cast strip is then subjected to a hot rolling operation in a hot mill.

The cast strip preferably enters the first hot rollers at a temperature in the range from about 880° F. to about 1000° F. (470° C. to 540° C.), and more preferably in the range from about 900° F. to about 975° F. (480° C. to 525° C.). The hot rollers preferably reduce the thickness of the strip by at least about 70 percent and more preferably by at least about 80 percent. It is preferred to maximize the percentage reduction in the hot mill.

It has been unexpectedly found that strip product having improved properties can be obtained if, in addition to the other process steps indicated herein, the temperature of the strip exiting the hot mill is minimized. To obtain the desired product properties, the exit temperature from the hot mill should be no more than about 650° F. (340° C.), and is preferably from about 620° F. to about 640° F. (325° C. to 340° C.). However, as is indicated hereinabove, this temperature should be minimized. For example, if the thickness of the cast strip exiting block caster is less than about 0.6 inches (15.2 mm), the hot mill exit temperature can be reduced to about 500° F. (260° C.).

The strip is preferably held at the hot mill exit temperature for a period of time, coiled and then annealed (also known as heat treatment). It is believed that this annealing step is critical to reducing the earing in the final strip stock. Preferably, the coiled strip is annealed for at least about three hours, preferably at a temperature from about 820° F. to about 830° F. The coiled strip can be annealed for less than about 3 hours at a temperature from about 775° F. to about 830° F. (410° C. to 445° C.). The temperature of the coil upon exiting the annealing step is preferably about 500° F. (260° C.), and it is allowed to cool to ambient temperature.

Alternatively, if the strip has sufficient mass, such as greater than about 13,000 pounds, it may be self-annealed by coiling the strip very tightly and allowing it to cool slowly to ambient temperature. This process may take as long as two days or more, but is advantageous since no additional heat is necessary to anneal the strip and thus energy costs are reduced.

After the annealed coil has cooled to ambient temperature, it is cold rolled to a final gauge in at least one stage of cold roll passes, and preferably in two stages. In the first cold rolling stage, the thickness is preferably reduced by about 40 percent to about 80 percent.

The first cold rolling stage can include a single cold roll pass. Preferably, at least two cold roll passes are employed, the first pass causing a thickness reduction of up to about 40 percent and the second cold roll pass causing an additional reduction of about 35 percent to about 70 percent. It has been found that cold rolling using at least two cold roll passes in the first cold rolling stage produces a cast strip having better uniformity.

The temperature of the strip upon its exit from each cold rolling pass is approximately 150° F. to 200° F. (65° C. to 95° C.) due to the friction of the rollers on the alloy strip.

Following the first cold rolling stage, the strip is preferably annealed for about 3 hours at from about 650° F. to about 700° F. (340° C. to 375° C.). This intermediate anneal improves the formability and earing characteristics of the final strip.

After the cold rolled and annealed strip has cooled to ambient temperature, it goes through a second cold rolling stage in which the thickness is further reduced. The final cold rolling stage is a significant factor in controlling the earing of the product. The amount of reduction in thickness needed in the final cold roll stage, i.e., the final cold work percentage, determines the amount of reduction in thickness required in the first cold rolling stage.

The preferred final cold work percentage is that point at which the optimum balance between the yield strength and earing is obtained. This point can be readily determined for a particular alloy composition by plotting each of the yield strength and earing values against the cold work percentage. Once this preferred cold work percentage is determined for the final cold rolling stage, the gauge of the strip during the intermediate annealing stage and, consequently, the cold working percentage for the initial cold roll stage can be determined.

The final cold work percentage required to minimize earing is dependent upon the composition of the particular alloy. It is expected that aluminum alloys with higher magnesium content have higher cold-work percentages. According to the present invention, the thickness is reduced in the second cold rolling stage by about 35 percent to about 70 percent, preferably by about 45 percent to about 65 percent, and more preferably by about 50 percent to about 60 percent, to a final gauge of, for example, less than about 0.0116 inches (0.29 mm). The second stage can include a single cold rolling pass or can include two or more passes, and the final gauge can be, for example, 0.010 inches (0.254 mm).

The second cold rolling stage preferably includes stabilizing the cold rolled strip by employing a water-based rolling emulsion during the cold rolling process. The amount of reduction which is possible during cold rolling utilizing an oil-based emulsion is limited by the flash point of the emulsion. Greater reduction creates greater friction which increases the exit temperature of the strip. If the temperature rises above the flash point of the emulsion, a fire can occur. Consequently, the reduction must be limited such that the heat generated remains below the flash point of the oil-based emulsion.

By contrast, stabilizing during cold rolling by utilizing a water-based rolling emulsion reduces the chance of a fire. Therefore, greater thickness reductions may occur in each pass with temperatures as high as 300° F. to 350° F. (145° C. to 180° C.), temperatures which are much greater than would be safely possible with an oil-based emulsion. By stabilizing, the mechanical properties will be reduced during cold rolling so that the aluminum sheet will not experience any substantial decrease in strength during subsequent processing.

After the final cold rolling pass, the strip can be subjected to a tension leveling step to achieve a more uniform flatness. This is accomplished by pulling or stretching the strip between rollers.

The aluminum alloy sheet produced according to the present invention is useful for a number of applications. These applications include, but are not limited to, cable sheathing, venetian blind stock, and other building products. The alloy sheet produced according to the present invention is particularly useful for drawn and ironed container bodies and for container tops. When the aluminum alloy sheet is to be fabricated into container tops, the intermediate anneal step is preferably not performed. The alloy sheet has a yield strength greater than about 38 ksi (262 MPa), preferably greater than about 42 ksi (290 MPa)and more preferably greater than about 44 ksi (304 MPa). The alloy sheet has a tensile strength preferably greater than about 46 ksi and more preferably greater than about 48 ksi.

To produce drawn and ironed container bodies, the aluminum alloy sheet is cut into substantially circular blanks. The blanks are then shaped with a die to form a cup. The cup is drawn and ironed into a container body by forcing the cup through a series of dies having progressively smaller diameters.

Typically, after the container has been drawn and ironed, it is washed to remove any impurities. After washing, the container body is typically placed in a drying oven to remove moisture. The drying oven will typically be at a temperature of approximately 400° F. (204° C.) and the container will typically stay within the oven for about 3.5 minutes. Following the drying step, the container can be internally coated and painted on the exterior. After coating and painting, the container is again subjected to baking for about 3.5 minutes at about 400° F. (204° C.) to cure the paint and the coating.

A technique useful for measuring the strength of a container body is to measure the dome strength of the container. The dome strength is the internal pressure that a container can withstand before the dome at the bottom of the container yields, or deforms. Containers formed from a sheet of the alloy according to the present invention having a thickness from about 0.0110 inches to 0.0123 inches (0.28 mm to 0.31 mm), have a minimum dome strength of at least about 90 psi (0.62 MPa), more preferably at least about 96 psi (0.66 MPa) and most preferably at least 100 psi (0.69 MPa).

To produce a 90 psi container, suitable for soda and other highly carbonated beverages, it is preferable that the container maintain a strength of at least about 38 ksi (262 MPa) yield strength after the final baking process described above.

The aluminum alloy sheets according to the present invention preferably have a yield strength greater than about 38 ksi (262 MPa) after the stabilization, and more preferably greater than about 40 ksi (276 MPa) after the stabilization.

Additionally, the alloy sheet according to the present invention preferably has a 45° earing percentage of less than about 2 percent, more preferably less than about 1.8 percent, and most preferably less than about 1.7 percent. This low earing characteristic facilitates the manufacture of drawn and ironed container bodies, reduces the labor required during the drawing and ironing, and minimizes plant scrap.

EXAMPLES

Example 1

As an example of the production of aluminum sheet of the present invention, a melt derived from scrap aluminum was adjusted to have a manganese concentration of 1.0 weight percent and a magnesium concentration of 2.8 weight percent. The resulting alloy composition was cast as a strip in a continuous chill block caster through a 16 mm distributor tip. Hot rolling reduced the cast strip to a gauge of 0.085 inches (2.16 mm) with an exit temperature of from 620° F. to about 640° F. (325° C. to 340° C.). The hot rolled strip was subsequently annealed (heat treated) for about three hours at 825° F. (440° C.).

Following the annealing were two cold rolling stages. The first stage included two cold roll passes, the first pass reducing the strip to a gauge of 0.055 inches (140 mm) and the second reducing the strip to a gauge of 0.017 inches (0.43 mm). The cold rolled strip was then intermediate annealed at 650° F. to 700° F. (340° C. to 375° C.) and cold rolled in a second stage, comprising a single pass, to a final gauge of 0.0110 inches (0.28 mm).

Testing of the resulting strip stock demonstrated a tensile strength of 46.5 to 51.3 ksi (320 MPa to 355 MPa), a yield strength of 43.6 to 46.8 ksi (300 MPa to 323 MPa) and a percent elongation of 2 to 4 percent. The 45° earing percentage was 2.2 percent and the dome strength was 97 psi.

Example 2

Table 3 illustrates the results of tests showing the effect of increasing the final cold work percentage on ultimate tensile strength (UTS), yield tensile strength (YTS) and 45° earing percentage of a sheet fabricated from Alloy A in accordance with the process of the present invention:

TABLE 3

| Cold Work | UTS (ksi) | YTS (ksi) | Earing (%) |
|---|---|---|---|
| 45% | 46.5 | 44.4 | 1.8 |

TABLE 3-continued

| Cold Work | UTS (ksi) | YTS (ksi) | Earing (%) |
|---|---|---|---|
| 55% | 49.5 | 45.9 | 2.4 |

Increasing the cold work increases the strength but also increases the earing. By comparison, a sheet fabricated from Alloy C in accordance with the process of the present invention with cold work of 55 percent has a tensile strength of about 48.7 ksi (336 MPa), a yield strength of about 46.1 ksi (318 MPa) and a 45° earing percentage of about 1.7 percent.

Example 3

Figure 3:
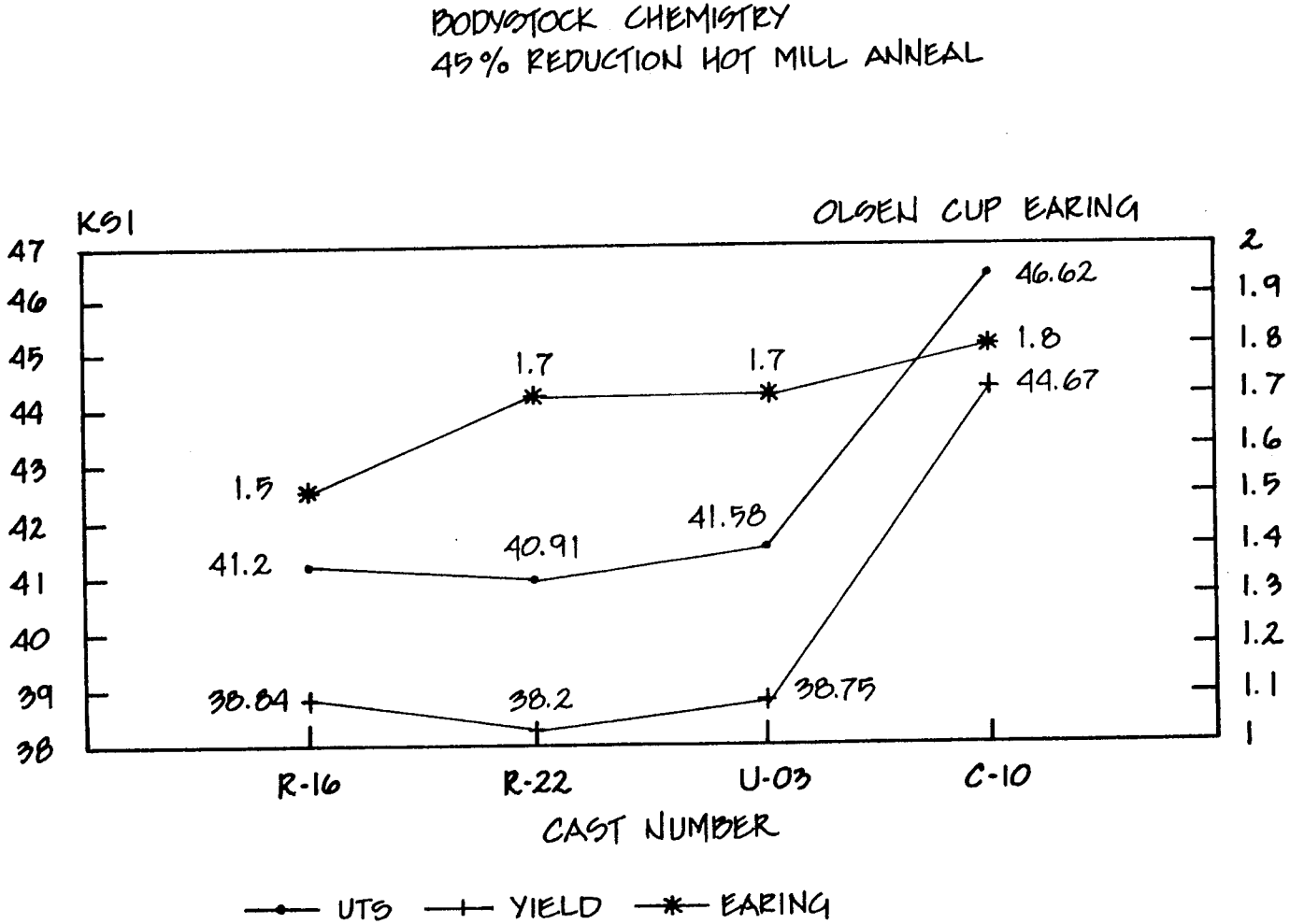
FIG. 3 is a chart illustrating the effect of altering the manganese and magnesium concentrations on strength and earing characteristics of aluminum sheets of the present invention.

FIG. 3 graphically illustrates the effect of changes in the amounts of mangnese and magnesium on ultimate tensile strength (UTS), yield strength and earing percentage in aluminum alloy sheets fabricated in accordance with the present invention.

The alloys identified as R-16, R-22 and U-03 are AA 5017 alloys and the alloy identified as C-10 is Alloy A of the present invention (from Table 2 above). The concentrations of manganese and magnesium in each of the alloys is set forth in Table 4:

TABLE 4

| | (weight percent) | | | |
|---|---|---|---|---|
| | R-16 | R-22 | U-03 | C-10 |
| Mn | 0.75 | 0.70 | 0.67 | 1.05 |
| Mg | 1.85 | 1.83 | 2.1 | 2.8 |

It can be seen that increasing the manganese and magnesium concentrations from the amounts in the AA 5017 alloys to the amounts in the C-10 alloy causes an increase in both tensile strength and yield strength. It also causes some increase in earing, although the earing percentage does not exceed the desirable 2 percent limit.

Example 4

The following example illustrates the high strength of containers fabricated from aluminum sheet of the present invention.

Aluminum alloy sheets were produced using Alloy A, having 1.0 weight percent manganese and 2.8 weight percent magnesium, in accordance with the process of the present invention. During the process, some of the sheets were stabilized during cold rolling, while the others were not. The sheets were cold rolled to three gauges and fabricated into two-piece aluminum beverage containers which were then subjected to dome strength testing to measure the maximum internal pressure which a sealed container can withstand. The results are shown in Table 5:

TABLE 5

| Gauge (inches) | | Dome Strength (psi) Average | 3 Sigma Low |
|---|---|---|---|
| 0.110 | | | |
| | as rolled | 97 | 92 |
| | stabilized | 98 | 94 |
| 0.114 | | | |
| | as rolled | 102 | 98 |
| | stabilized | 102 | 99 |
| 0.116 | | | |
| | as rolled | 104 | 100 |
| | stabilized | 102 | 98 |

The term "3 sigma low" in Table 5 refers to three standard deviations and indicates the lowest dome strength statistically predictable.

As indicated in Table 5, containers fabricated from aluminum sheet of the present invention employing the preferred process described hereinabove have sufficient strength to withstand the internal pressures generated by pasteurized beer and other highly carbonated beverages even in thin gauges.

While various embodiments of the present invention have been described in detail, it is apparent that modifications and adaptations of those embodiments will occur to those skilled in the art. For example, the aluminum alloy sheet of the present invention can be fabricated by the use of processes other than the process of the present invention and derived from alloys other than the alloys of the present invention. It is to be expressly understood that such modifications and adaptations are within the spirit and scope of the present invention, as set forth in the following claims.

What is claimed is:

1. An aluminum alloy sheet suitable for manufacturing drawn and ironed container bodies, said sheet having a yield strength greater than about 42 ksi and a 45° earing percentage of less than about 2 percent.

2. An aluminum alloy sheet as recited in claim 1, wherein said sheet is formed from an alloy composition comprising:

(a) from about 2.0 to about 2.8 weight percent magnesium; and (b) from about 0.9 to about 1.6 weight percent manganese.

3. An aluminum alloy sheet as recited in claim 1, wherein said sheet is formed from an alloy composition comprising:

(a) from about 2.0 to about 2.1 weight percent magnesium; and (b) from about 1.5 to about 1.6 weight percent manganese.

4. An aluminum alloy sheet as recited in claim 1, wherein said sheet is formed from an alloy composition comprising:

(a) from about 2.6 to about 2.8 weight percent magnesium; and (b) from about 0.9 to about 1.0 weight percent manganese.

5. An aluminum alloy sheet as recited in claim 1, wherein said sheet is formed from an alloy composition comprising:

(a) from about 2.6 to about 2.8 weight percent magnesium; and (b) from about 1.3 to about 1.5 weight percent manganese.

6. An aluminum alloy sheet as recited in claim 1, wherein said sheet has a yield strength greater than about 44 ksi.

7. An aluminum alloy sheet as recited in claim 1, wherein said sheet has a 45 earing percentage of less than about 1.8 percent.

8. An aluminum alloy sheet as recited in claim 1, wherein at least a portion of said sheet is derived from aluminum container scrap.

9. An aluminum alloy sheet as recited in claim 1, wherein said sheet has a thickness of less than about 0.0115 inches.

10. An aluminum alloy sheet as recited in claim 1, wherein said sheet has an elongation of at least about two percent.

11. An aluminum alloy sheet as recited in claim 1, wherein said sheet has an ultimate tensile strength of at least about 46 ksi.

12. An aluminum alloy sheet, comprising:

(a) from about 2.0 to about 2.8 weight percent magnesium;

(b) from about 0.9 to about 1.6 weight percent manganese;

(c) from about 0.13 to about 0.20 weight percent silicon;

(d) from about 0.25 to about 0.35 weight percent iron; and (e) from about 0.20 to about 0.25 weight percent copper.

13. An aluminum alloy sheet as recited in claim 12, wherein said sheet has a yield strength of at least about 38 ksi and a 45° earing percentage of less than about 2 percent.

14. An aluminum alloy sheet as recited in claim 12, wherein said aluminum alloy sheet is capable of being formed into aluminum container bodies and ends.

15. An aluminum alloy sheet, comprising:

(a) from about 2 to about 2.8 weight percent magnesium;

(b) from about 0.9 to about 1.6 weight percent manganese;

(c) from about 0.13 to about 0.20 weight percent silicon;

(d) from about 0.25 to about 0.35 weight percent iron; and (e) from about 0.20 to 0.25 weight percent wherein said aluminum alloy sheet has a yield strength of at least about 42 ksi and a 45 earing percentage of less than about 1.8 percent.

16. An aluminum container having a dome, wherein said dome has a strength of at least about 90 psi and said dome has a thickness of less than about 0.012 inches.

17. An aluminum container as recited in claim 16, wherein said dome has a strength of at least about 94 psi.

18. An aluminum container as recited in claim 16, wherein said dome has a strength of at least about 97 psi.

* * * * *